US007611011B2

(12) United States Patent
Skoufis

(10) Patent No.: US 7,611,011 B2
(45) Date of Patent: Nov. 3, 2009

(54) PEROXIDE PRESERVATION

(75) Inventor: John Skoufis, Denville, NJ (US)

(73) Assignee: Illinois ToolWorks, Inc., Glenview, IL (US)

( * ) Notice: Subject to any disclaimer, the term of this patent is extended or adjusted under 35 U.S.C. 154(b) by 902 days.

(21) Appl. No.: 09/879,613

(22) Filed: Jun. 12, 2001

(65) Prior Publication Data

US 2002/0070130 A1 Jun. 13, 2002

Related U.S. Application Data

(60) Provisional application No. 60/210,969, filed on Jun. 12, 2000.

(51) Int. Cl.
*B65D 83/10* (2006.01)
*B65D 69/00* (2006.01)

(52) U.S. Cl. ..... 206/361; 206/446; 206/209; 206/229; 15/184

(58) Field of Classification Search ..... 206/205–207, 206/209 X, 222, 229, 233, 568 X, 812 X, 206/361, 446, 397, 407, 408, 210; 15/104.94 X, 15/244.1 X, 244.4, 184, 257.01, 257.05, 258; 53/427 X, 428, 469 X; 132/313, 317
See application file for complete search history.

(56) References Cited

U.S. PATENT DOCUMENTS

| | | | | |
|---|---|---|---|---|
| 3,785,569 | A | | 1/1974 | Helmrich |
| 3,789,569 | A | | 2/1974 | Egger |
| 3,911,640 | A | | 10/1975 | Rausing |
| 3,947,249 | A | | 3/1976 | Egger |
| 4,131,195 | A | * | 12/1978 | Worrell, Sr. ..... 206/205 |
| 4,437,567 | A | | 3/1984 | Jeng |
| 4,888,229 | A | * | 12/1989 | Paley et al. ..... 428/192 |
| 5,554,659 | A | | 9/1996 | Rosenblatt |
| 5,814,159 | A | * | 9/1998 | Paley et al. ..... 134/6 |
| 5,858,109 | A | * | 1/1999 | Hymes et al. ..... 134/2 |
| 5,881,876 | A | | 3/1999 | Nonomura et al. |
| 5,928,516 | A | | 7/1999 | Hopkins et al. |
| 5,988,371 | A | * | 11/1999 | Paley et al. ..... 206/229 |
| 6,004,640 | A | * | 12/1999 | Pisacane et al. ..... 428/36.5 |
| 6,012,576 | A | | 1/2000 | Onodera |
| 6,068,820 | A | | 5/2000 | De Guzman |
| 6,076,662 | A | * | 6/2000 | Bahten ..... 206/207 |

FOREIGN PATENT DOCUMENTS

GB 2221389 7/1990

* cited by examiner

*Primary Examiner*—Jila M Mohandesi
(74) *Attorney, Agent, or Firm*—Gregory N. Neff, Esq.

(57) ABSTRACT

Clean room cleaning articles such as PVA sponge brushes and pre-saturated wipers are packaged in a sealed container with a de-ionized water containing around 0.05 to 1% hydrogen peroxide.

6 Claims, 1 Drawing Sheet

PEROXIDE PRESERVATION

Figure 1:
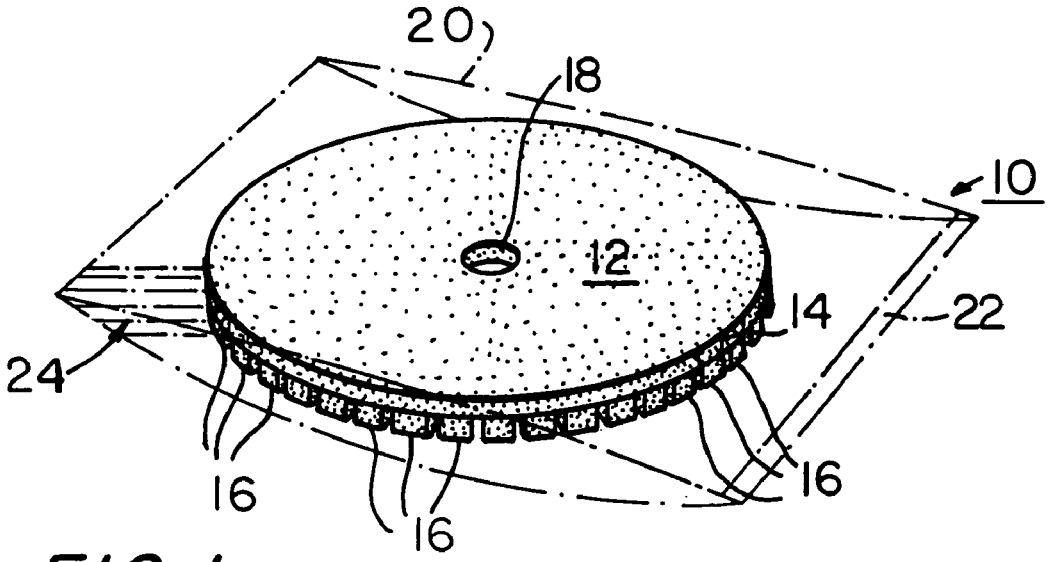

This patent application claims priority from Provisional Patent Application Ser. No. 60/210,969 filed Jun. 12, 2000 and entitled "Peroxide Preservation".

This invention relates to processes and structures for packaging and preserving the cleanliness of clean room cleaning articles such as PVA sponge brushes and pre-saturated clean room wipers.

The invention includes a method of packaging PVA "rollers" (sponges) of the type shown in U.S. Pat. No. 4,566,911 in a sealed package with a solution of de-ionized water and hydrogen peroxide absorbed in the sponge.

Sponges of the type here under discussion are used in the cleaning of semi-conductor wafer surfaces and other delicate surfaces to be cleaned in a clean-room atmosphere.

The sponges usually are shipped wet; that is, with pure water absorbed into the sponge material to keep it flexible. If it is not kept in a wet condition, it dries out and becomes very hard. This is deleterious to its performance in the cleaning tasks it is used for.

Traditionally, synthetic agents have been used to preserve susceptible materials, especially water-containing, and where residual contamination is not an issue, they have been effective. Since from manufacturing to final processing of PVA (polyvinyl alcohol) can be several months, preservatives are used to prevent bacterial and mold growth which is difficult to completely remove by subsequent cleaning. The typical synthetic preservatives are also hard to remove and can serve as a potential contaminate in clean processes.

Other sterilization methods are available. These include E-beam (electron beam) and gamma radiation.

E-beam is ineffective unless each package is clearly exposed to the irradiation. Boxed lots usually would not achieve sufficient penetration to assure complete exposure of the brush. Gamma radiation is effective but much more costly and at irradiation levels for sterilization, about 25 KGY, product degradation may occur.

Some pre-saturated clean room wipers have the same problems as PVA sponges. If the cleaning solution absorbed in the wiper is not sufficiently bactericidal, bacteria can live and multiply in the package in which the wipers are contained.

PVA sponges (sponge brushes, in particular) and wipers for clean room use are subjected to severe restrictions on the quantities of impurities they can contain. These impurities include metal ions, anionic materials such as chlorides, fluorides, phosphates and bromides, and particulates.

In the manufacture of semiconductor devices, objectionable particulates includes bacteria, which often are of the same order of magnitude as conductor spacings in such devices.

Accordingly, it is an object of the invention to provide a clean room cleaning article, packaging method and structure which avoid or alleviate the foregoing problems.

In particular, it is an object to provide a relatively simple, inexpensive method and structure which are highly effective for killing and preventing the growth of bacteria in the packages in which the cleaning articles are stored.

In accordance with the present invention, hydrogen peroxide is used as a bactericide and preservative to take advantage of the following features:

1. It is highly effective over a wide range of organisms.

2. It is safe at the concentrations used.

3. Its breakdown products are non-hazardous, nonpolluting, and are not process contaminants.

4. It hydrolyzes formaldehyde which is used as a reactant chemical, eliminating any residue of this hazardous compound.

Hydrogen peroxide has been used as a disinfectant and bactericide since the 1800's due to its strong oxidizing properties. It has been shown to be both effective and safe. Compared to commonly used chlorine it has a 28% greater oxidation potential. Its reaction to oxidizable materials converts it to water and oxygen (2H2O2 - - - 2H2O+02) compared to the hazardous decomposition products produced by other compounds, such as chlorine, chlorine dioxide, and fluorine. For this reason, it has found wide use in water treatment and medical applications. Since hydrogen peroxide is a natural metabolite of most organisms, decomposition into water and oxygen is a standard reaction they set off. In addition, UV light on water also forms hydrogen peroxide in nature which serves as a natural purification system.

Testing has shown that hydrogen peroxide can be used without irradiation, which has an adverse physical effect at sterilization levels, to provide a sterile product prior to final manufacture or for finished distribution.

It has been discovered that, by mixing hydrogen peroxide with the de-ionized water which is used to soak the sponge before shipment, bacterial growth is inhibited.

Although hydrogen peroxide is known as a bactericide, the use of hydrogen peroxide produces an unexpected benefit. This is due to the fact that the hydrogen peroxide-water solution tends to deteriorate fairly rapidly. When it does, it changes into very benign components; water and oxygen. Moreover, the deterioration does not produce any metal ions or debris of any kind which would compromise the cleanliness of the ultra-clean sponges, but does not permit bacteria to grow.

Thus, when the customer receives the product, the hydrogen peroxide will have decomposed into its benign components so that there are no chemicals to interfere with the use of the sponge in its intended cleaning process; the sponge is soaked with pure, bacteria-free water.

In actual use, in packaging PVA sponges for used in medical uses or semiconductor wafer scrubbing or other ultraclean applications, the sponge material is loaded with a mixture of very pure de-ionized water and a small percentage of hydrogen peroxide, by volume. The amount of hydrogen peroxide is selected so as to be low enough to give reasonable assurance that it will actually decompose into its components by the time the package is opened to remove the material for use.

Advantageously, the package can be a sealed plastic package of the type in which pre-saturated clean-room wipers are shipped.

In accordance with a further aspect of the invention, it has been discovered that the use of hydrogen peroxide concentrations within ranges proposed by prior users of hydrogen peroxide (e.g., 1% to 5%) can have a deleterious effect by creating unwanted impurities, such as methyl ions. Therefore, a substantially lower concentration of about 0.05 to 1%, preferably about 0.1%, is used, thereby avoiding the deleterious effects of the higher concentrations.

The PVA sponges (rollers, discs, etc.), and the pre-saturated wipers preferably are placed and sealed in plastic bags with an appropriate amount of liquid; more than enough to saturate the PVA sponges, and, usually, less than saturation level in the wipers.

The foregoing and other objects and advantages of the invention will be set forth or be apparent from the following description and drawings.

IN THE DRAWINGS

Figure 2:
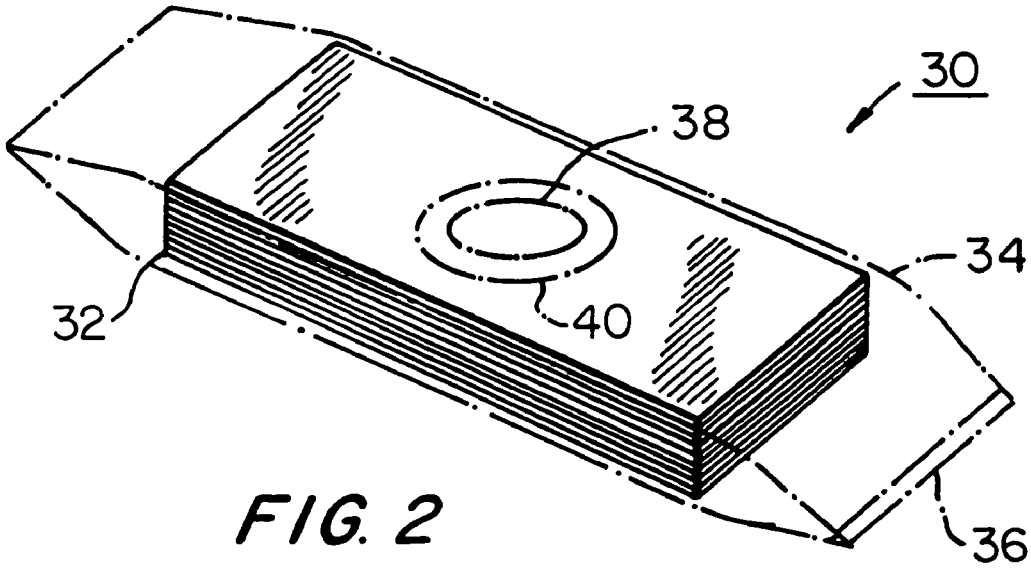

FIG. 1 is a perspective, partiality schematic view of a PVA sponge packaged in accordance with the present invention; and FIG. 2 is a perspective view of pre-saturated clean room wipers in accordance with the present invention.

FIG. 1 shows a package 10 containing circular PVA sponge brush 12 and a bath of liquid (not visible but indicated at 24) surrounding the sponge 12. The bag 20 is preferably made of polyethylene, and is heat-sealed shut along one edge 22.

The sponge 12 has a body 14 with a plurality of sponge fingers or knobs 16 extending downwardly from the body 14. The sponge 13 has a central hole 18 for receiving a drive member on a semiconductor wafer scrubbing machine.

The liquid 24 is a mixture of highly pure de-ionized water and ultra-pure, semiconductor grade hydrogen peroxide, in the amount of about 0.1% by volume.

The range of usable hydrogen peroxide concentrations is from a low value sufficient to kill bacteria, believed to be around 0.05%, to a high value believed to be under or around 1%. The high value is one at which metal ions or other impurities developed are at intolerable levels. For PVA sponge, a concentration of around 0.1% is preferred.

It should be understood that the shape of the sponge 12 can vary widely. For example, it can be cylindrical, with knobs extending from the surface, or it can have one of many other shapes.

It has been found that hydrogen peroxide when supplied at concentrations within the foregoing range of values, is very likely to decompose into water and oxygen before the cleaning article is removed from the package for use. Thus, it will not be present in the PVA sponge when it is used, and the sponge will be within specifications for all contaminants.

FIG. 2 shows a package 30 of pre-saturated wipers 32 in a polyethylene bag 34 which is heat-sealed along one edge 36. A central opening 38 is covered by a removable and replaceable adhesive cover 40, which can be removed to withdraw a wiper from the package, and replaced to prevent the remaining wipers 32 from drying out.

A quantity of cleaning liquid is absorbed in the wipers. The liquid can be a solvent or other cleaning liquid, or it can be de-ionized water. If the liquid contains high concentrations of alcohol or other substances which kill bacteria, then an additional bactericide is not needed. However, if the liquid is pure de-ionized water or other non-bactericide, the addition of 0.05 to 1%, preferably 0.1%, hydrogen peroxide is effective in killing and inhibiting the growth of bacteria, in the same manner as with the PVA sponge, as described above.

The preferred material for the bag 20 and 34 is polyethylene, but any other flexible, non-reactive durable and relatively inexpensive material can be used instead.

The wipers 32 can be made of polypropylene or other suitable synthetic or natural materials.

The invention provides clean room cleaning article wet storage with a long shelf life (six months, one year and more, e.g.), without significant increase in contamination, without the cost of gamma and other irradiation or the short-comings of the other known prior techniques and materials.

The above description of the invention is intended to be illustrative and not limiting. Various changes or modifications in the embodiments described may occur to those skilled in the art. These can be made without departing from the spirit or scope of the invention.

What is claimed is:

1. A method of packaging a PVA sponge for use in scrubbing semiconductor wafers, said sponge having particulate, metal ion and anionic counts at or below the value specified for a clean room, said method comprising:

(a) placing said sponge in a flexible plastic bag;

(b) said sponge containing a quality of de-ionized water with around 0.05% to around 0.01% by volume of hydrogen peroxide; and (c) sealing said bag.

2. A method as in claim 1 in which said quality of de-ionized water with hydrogen peroxide is between an amount sufficient to wet said sponge and an amount necessary to saturate said sponge.

3. A method as in claim 1 in which volume of hydrogen peroxide is around 0.1%.

4. A method of packaging a PVA sponge brush, said sponge brush having particulate, metal ion and anionic counts at or below the values for a clean room, said method comprising placing said cleaning article in a plastic bag, said sponge brush containing a quantity of de-ionized water, said water containing hydrogen peroxide in an amount effective to kill and retard the growth of bacteria in said cleaning article but less than an amount sufficient to develop significant quantities of metallic ions in said container, and sealing said container, in which said amount of hydrogen peroxide is about 0.05% to around 0.1 by volume.

5. A packaged PVA sponge for use in clean rooms, said cleaning article having particulate, metal ion and anionic counts at or below the values specified for a clean room, said package comprising a sealed flexible plastic bag, said sponge being positioned in said bag, and containing a quantity of de-ionized water, said de-ionized water containing hydrogen peroxide in a concentration effective to kill and retard the growth of bacteria in said sponge, said amount being low enough to substantially ensure decomposition of said hydrogen peroxide in a relatively short period of time after the container is sealed and being between 0.05% and 0.1% by volume.

6. A cleaning article as in claim 5 in which said cleaning article is a PVA sponge for scrubbing semiconductor wafer surfaces, and said concentration of hydrogen peroxide is around 0.1 percent by volume.

* * * * *

UNITED STATES PATENT AND TRADEMARK OFFICE

CERTIFICATE OF CORRECTION

PATENT NO. : 7,611,011 B2
APPLICATION NO. : 09/879613
DATED : November 3, 2009
INVENTOR(S) : John Skoufis It is certified that error appears in the above-identified patent and that said Letters Patent is hereby corrected as shown below:

Claim 1, Column 4, line 17, the phrase "a quality of de-ionized water" should read "a quantity of de-ionized water". Claim 1, Column 4, line 18, the phrase "0.05% to around 0.01%" should read "0.05% to around 0.10%".

Signed and Sealed this
Ninth Day of October, 2012

David J. Kappos

David J. Kappos
*Director of the United States Patent and Trademark Office*

US007611011C1

(12) EX PARTE REEXAMINATION CERTIFICATE (9584th)

United States Patent

Skoufis

(10) Number: US 7,611,011 C1

(45) Certificate Issued: Apr. 1, 2013

(54) PEROXIDE PRESERVATION

(75) Inventor: John Skoufis, Denville, NJ (US)

(73) Assignee: Illinois Tool Works Inc., Glenview, IL (US)

Reexamination Request:
No. 90/012,484, Sep. 10, 2012

Reexamination Certificate for:

| | |
|---|---|
| Patent No.: | **7,611,011** |
| Issued: | **Nov. 3, 2009** |
| Appl. No.: | **09/879,613** |
| Filed: | **Jun. 12, 2001** |

Certificate of Correction issued Oct. 9, 2012.

Related U.S. Application Data

(60) Provisional application No. 60/210,969, filed on Jun. 12, 2000.

(51) Int. Cl.

| | |
|---|---|
| ***B65D 83/10*** | (2006.01) |
| ***B65D 69/00*** | (2006.01) |
| ***A46B 11/00*** | (2006.01) |
| ***C11D 3/39*** | (2006.01) |
| ***C11D 11/00*** | (2006.01) |
| ***C11D 17/04*** | (2006.01) |

(52) U.S. Cl.
USPC ..... 206/361; 15/184; 206/209; 206/229; 206/446

(58) Field of Classification Search ..... None
See application file for complete search history.

(56) References Cited

To view the complete listing of prior art documents cited during the proceeding for Reexamination Control Number 90/012,484, please refer to the USPTO's public Patent Application Information Retrieval (PAIR) system under the Display References tab.

*Primary Examiner* — Evelyn Huang

(57) ABSTRACT

Clean room cleaning articles such as PVA sponge brushes and pre-saturated wipers are packaged in a sealed container with a de-ionized water containing around 0.05 to 1% hydrogen peroxide.

EX PARTE REEXAMINATION CERTIFICATE ISSUED UNDER 35 U.S.C. 307

NO AMENDMENTS HAVE BEEN MADE TO THE PATENT

AS A RESULT OF REEXAMINATION, IT HAS BEEN DETERMINED THAT:

The patentability of claims 1-6 is confirmed.

* * * * *